United States Patent [19]

Kussel et al.

[11] Patent Number: 5,062,033

[45] Date of Patent: Oct. 29, 1991

[54] ELECTRO-HYDRAULIC CONTROL SYSTEM FOR A MINERAL MINING INSTALLATION

[75] Inventors: Willy Kussel, Werne; Johannes König; Martin Reuter, both of München, all of Fed. Rep. of Germany

[73] Assignee: Gewerkschaft Eisenhutte Westfalia GmbH, Fed. Rep. of Germany

[21] Appl. No.: 191,551

[22] Filed: May 9, 1988

[30] Foreign Application Priority Data

May 9, 1987 [DE] Fed. Rep. of Germany ..... 3715586

[51] Int. Cl.[5] ..... G06F 15/46; E21D 23/12

[52] U.S. Cl. ..... 364/187; 364/133; 364/400; 405/302

[58] Field of Search ..... 364/184, 187, 131-133, 364/200, 900, 400; 371/4, 8, 8.1, 8.2; 340/825.01, 827; 405/302

[56] References Cited

U.S. PATENT DOCUMENTS

| | | | |
|---|---|---|---|
| 4,159,470 | 6/1979 | Strojny et al. | 371/8 |
| 4,352,103 | 9/1982 | Slater | 340/825.01 |
| 4,398,851 | 8/1983 | Geuns et al. | 405/302 |
| 4,451,181 | 5/1984 | Trumper et al. | 405/302 |
| 4,490,785 | 12/1984 | Strecker et al. | 364/200 |
| 4,518,285 | 5/1985 | Weber et al. | 405/302 |
| 4,575,842 | 3/1986 | Katz et al. | 340/825.01 X |
| 4,607,330 | 8/1986 | McMurray et al. | 364/200 |
| 4,692,067 | 9/1987 | Ward et al. | 405/302 |
| 4,748,560 | 5/1988 | Kataoka | 340/825.01 X |

*Primary Examiner*—Joseph Ruggiero

*Attorney, Agent, or Firm*—Samuels, Gauthier & Stevens

[57] ABSTRACT

An electro-hydraulic control system for a mineral mining installation has a plurality of control units (4) subdivided into operational groups (I, II, III) with associated roof supports. Each group has its own power source (5) and power at an intrinsically safe level is provided to each of the groups independently of and in isolation from the other groups. The control units (4) are interconnected via a system data bus (13,14) in the form of conductors of multi-core cables which also carry the electrical power. A further data bus (20) independent of the system bus (13,14) is coupled to some of the units of the groups.

14 Claims, 5 Drawing Sheets

ELECTRO-HYDRAULIC CONTROL SYSTEM FOR A MINERAL MINING INSTALLATION

FIELD OF THE INVENTION

The present invention relates in general to electro-hydraulic control systems for mineral, e.g. coal, mining installations.

BACKGROUND ART

In known electro-hydraulic control systems and installations, a series of roof supports, together with their ancillary hydraulic devices, are disposed along a mine working and each support is associated with a control unit which has a programmable electronic device, particularly a micro-processor, forming part of a computer controlled system. Electromagnetic valves are operated under control of the units to cause the hydraulic devices and equipment to operate in some predetermined sequence.

Electro-hydraulic control systems are known in various versions (See "Gluckauf", 1981, pp. 1155–1162; "Gluckauf", 1984, pp. 135–140; "Gluckauf", 1986, pp. 543–552 and "Gluckauf", 1986, pp. 1183–1187). In practice, the systems which have proved best have all the control units connected with one another for serial data transmission, and with a central control station via a common data transmission system bus. The individual control units are usually provided with an operating keyboard which permits the individual hyraulic devices to operate as well as initiating control operations on the adjacent supports and also control operations in the so-called sliding sets or groups of supports. The control system can be so constructed that a control sequence can be started up from each support, the operator having the choice of letting the control proceed away from or towards himself. The control system is preferably supplied with power on a decentralized basis, for example, each support and each individual control unit may have its own power supply, which may be integrated with the lighting system for the working. Such decentralized power supply is highly reliable but may involve considerable outlay.

A general object of the invention is to provide an improved electro-hydraulic control system in which operational reliability is enhanced with the minimum possible outlay on construction or hardware.

SUMMARY OF THE INVENTION

As is apparent, the invention is concerned with an electro-hydraulic control system composed of individual control units each of which has some programmable device such as a computer or microprocessor, conveniently operated with a keyboard. The units can each be mounted on one of a series of roof supports together with a valve block with electromagnetic valves operated by a keyboard or the like associated with the local control unit in question or by another remote unit. The roof supports are sub-divided into operational sets or groups and each such group has its own separate power source providing a d.c. voltage at a safe level (typically 12v). The electrical power circuits are isolated from one another, but data signals can pass between the units over a system bus usually with several parallel data channels. The system bus can connect with a central control station.

The invention provides that in addition to the system bus a further separate redundant central or common bus passes through the working and only some of the individual control units in the groups or sets are coupled with the central bus. With this construction for the control system redundant data channels or paths are created in the working, so that the connection of the individual control units with one another and possibly with a central control unit can be maintained, even if the system bus is interrupted by a fault or power failure. Preferably, additional redundancy can be built into the system bus. In one embodiment, the system data bus is composed of bi-directional buses extending through the units of each group and coupled indirectly with the units of adjacent group to enable data signals to be transmitted between the bi-directional buses while isolating the buses in a d.c. sense and separate partial buses with parts interconnecting the units of each group only.

It is desirable to also provide energy storage means, such as batteries, which can maintain operation in an emergency.

The system bus can be conductors of multi-core cables which also carry the low voltage power. With the system according to the invention a comparatively simple linear bus structure can be adopted with high operational reliability. Since in addition to the system bus the central bus is available for parallel data transmission, it is possible to achieve a considerably higher information transmission rate with serial data transmission. In addition to the customary individual and run-off controls, group controls with sliding sets of supports can be performed, if desired, even without the use of a central control station.

The communication system has adequate capacity for the inclusion of additional functions in the control sequence. Hydraulic adjustment devices for extendable roof bars, for gap coverings etc., or even devices for the proportional shifting of the face conveyor or for the automatic step-by-step movement of the supports in accordance with the position of a mining machine, as well as further control and monitoring functions, can all be included in the sequence. Furthermore, the control system according to the invention enables a fault to be identified more clearly in the event of the failure of an individual control unit or a break in a cable or line.

Further in accordance with the invention, the sets or groups of control units provided with their own source of current are independent intrinsically safe systems from the standpoint of the power supply. As a number of individual control units are combined in each of these systems, the outlay on power packs and on wiring involved is far lower than in the case of the systems with individual current supply sources. The distribution of the current available within each set of individual control units can be effected via supply lines combined with the data system and preferably embodied as conductors of multi-core cables. The arrangement according to the invention also provides a versatile data bus structure in which between the individual control units and possibly between the central control station and the individual control units there are a number of data paths, so that even if certain individual units fail, the system as a whole can remain functional and safe. The inclusion of the central bus in the path of communication still makes it possible, in the event of a break in the cable which includes the system bus, to effect communication to identify the location of the fault if the individual control units in the zone affected by the fault are supplied from their emergency energy source.

The central bus is with advantage quite physically separate from the system bus and preferably laid along the face conveyor, so that in the event of a break in the main system, communication with all individual control units is maintained. In general, it is sufficient if each of the various sets of individual control units is coupled by only one of its individual control units to the central bus. This results in comparatively moderate outlay on wiring between the central bus and the associated individual control units.

Preferably, the system bus is interrupted in the d.c. sense by coupling means which preserves the electrical isolation between the power currents of the groups but allows data signals to pass. Optical couplers are suitable for this purpose, although transformers or capacitors could be used. Similar coupling means can also act between the central bus and the units.

In an advantageous embodiment of the invention the central bus is provided with a power supply system of its own from an intrinsically safe power source. This source can serve to feed the coupling means isolating the central bus from the sets of individual control units, as well as any devices for data editing or amplification. It is convenient for the central bus to be combined with power supply lines connected up to the central bus source to form a multi-core cable, preferably a three or four-core cable.

In accordance with the invention, an electro-hydraulic control system is provided for a mineral mining installation in a mine working which includes a plurality of roof supports equipped with hydraulic devices and electromagnetic valves for operating said devices under control of the system, the installation and the system being sub-divided into a plurality of operational groups and said control system comprising individual control units operably associated with the supports, each control unit having electronic programmable means for providing control signals to activate said valves within the associated one of the groups, individual power sources for providing electrical power at an intrinsically safe level to at least all the control units of the individual groups with associated electrical power currents within the groups being isolated from one another, a system data bus provided within the groups for transmitting data signals between the units and along the groups and a further separate central data bus extending along the working which is coupled to some of the units within the groups.

The invention may be understood more readily and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
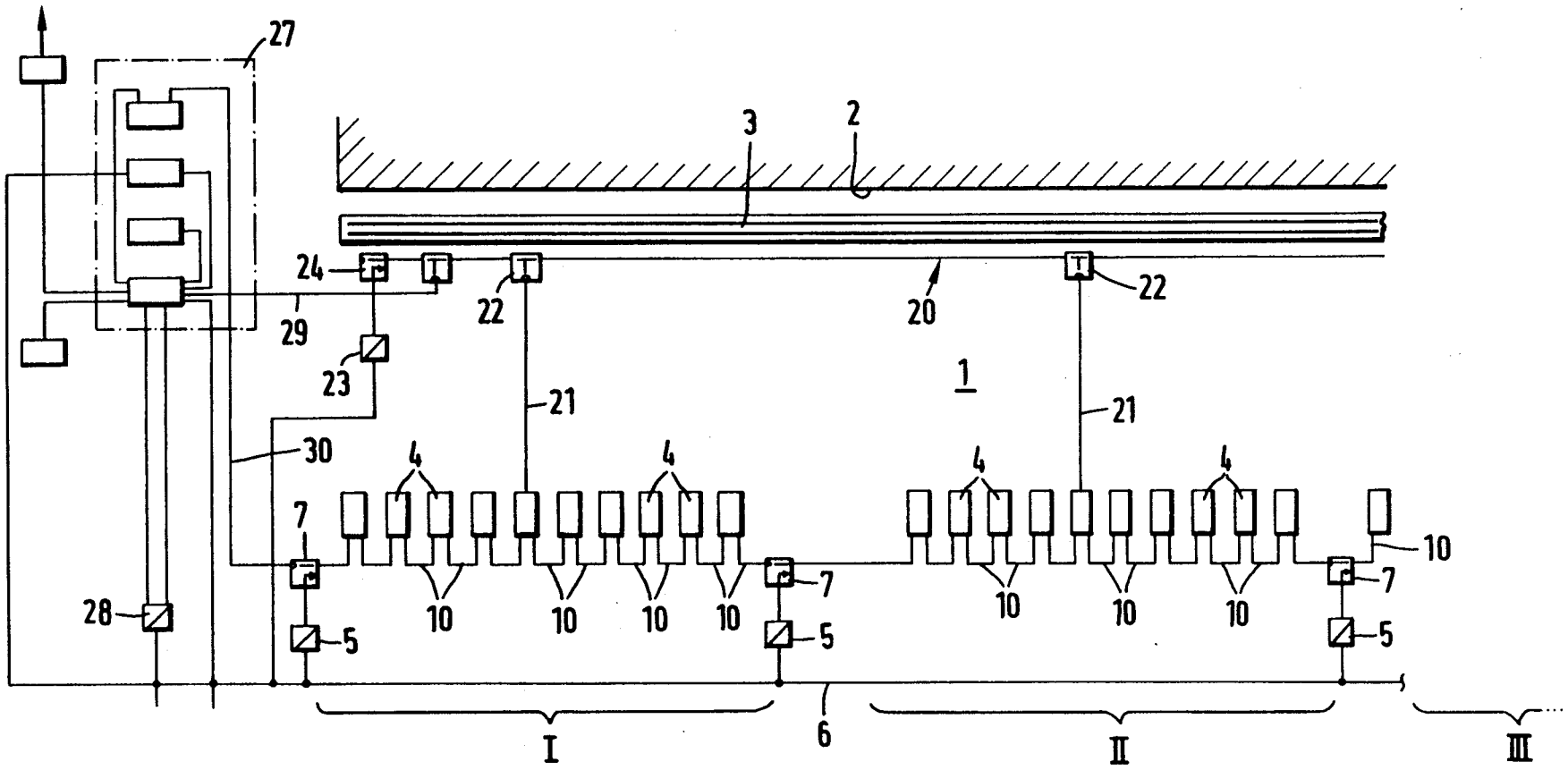
FIG. 1 is a schematic representation of a mineral mining installation and an electro-hydraulic control system constructed in accordance with the invention.
Figure 5:
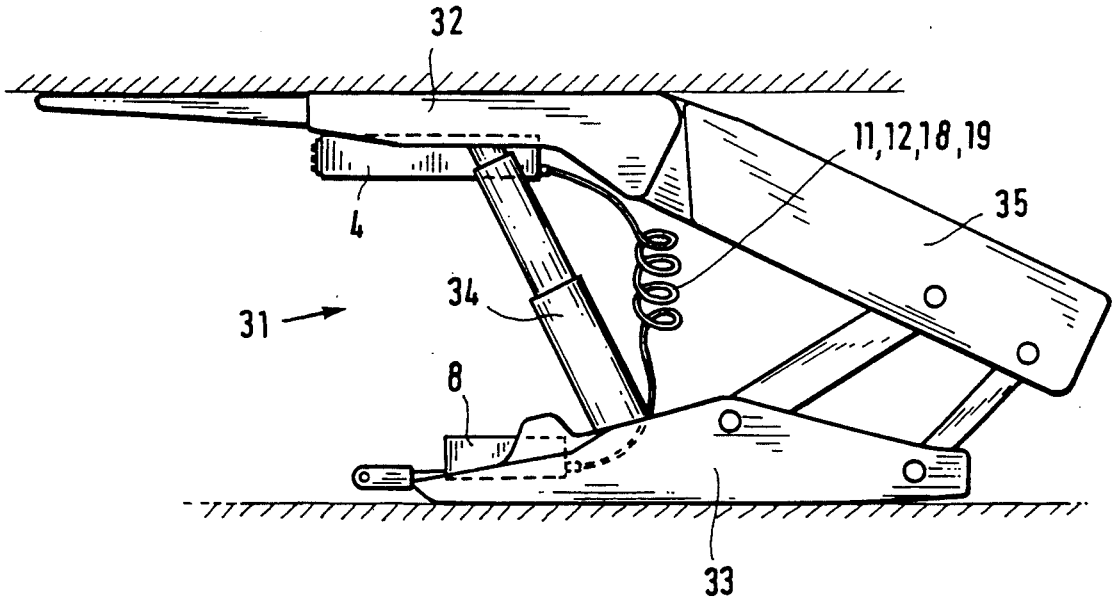
FIG. 5 depicts a roof support of the mining installation.

As shown in FIG. 1, a mineral mining installation is installed in a longwall mine working typically with a length of 200–300 meters. The working has a mineral, e.g. coal, face 2 and the installation has a scraper-chain conveyor 3 disposed alongside the face 2. The conveyor 3 is composed of individual channel sections or pans arranged end-to-end and the conveyor 3 is displaced from time to time towards the face 2 with the aid of shifting rams to follow the progress of winning mineral. The conveyor 3 transports the mineral detached from the face with the aid of a winning machine (not shown) such as a plough or shearer. On the side of the conveyor 3 remote from the face 2, there are a series of displaceable roof supports which form a step-by-step support lining for the working. The supports connect via the shifting rams to the conveyor 3. The operation of the installation is controlled with the aid of an electro-hydraulic control system which is described hereinafter. FIG. 5 depicts a typical roof support 31. As illustrated, the support 31 has a floor-engaging structure 33, a roof-engaging structure 32 and hydraulic props 34 disposed therebetween. A goaf shield 35 is pivotably connected to the roof structure 32 and a guide linkage interconnects the shield 35 to the floor structure 33. A control unit 4 forming part of the control system is mounted in a protected position beneath the roof structure 32. The unit 4 is associated with a multi-core cable with conductors 11, 12, 18, 19. The cable connects the unit 4, inter alia, to a valve block 8 mounted on the floor structure 33 via plug and socket connectors. The block 8 can be disposed in other positions, e.g. behind the props 34 or on the underside of the shield 35. An associated shifting ram (not shown) connects to a bracket at the front of the floor structure 33.

In the control system, (FIGS. 1–4), each support 31 has its own individual control unit 4 which has programmable electronic means, such as a microprocessor, in a protective housing. At least some of the units 4 have an operational interface with an accessible keyboard, designated 9, for manual operation. The keyboard 9 permits an operator to key in various functions to cause hydraulic consumer devices to operate locally and conveniently at some distance from the operator, e.g. on an adjacent roof support or one or more supports some distance removed. These operations, known per se, can involve retraction and extension of the props and/or of the shifting rams to displace a region of the conveyor and/or one or more of the roof supports.

The control system uses a de-centralised power supply for the control units 4. In each case, a number of adjacent control units 4 and adjacent support units 31 are combined to form a group or set designated I, II, III etc. In this embodiment, each set I, II, III etc. has ten control units 4 and is provided with its own power pack or source 5. Each power pack 5 is connected to a common supply line 6 which carries, e.g. 220v, a.c. and extends along the working. The power packs 5 are independent however so that each set I, II, III etc. is likewise separate in a galvanic sense. The power packs 5 transform the supply voltage to a lower d.c. supply at an intrinsically safe level, e.g. 12 volts. Each power pack 5 drives a current feed adaptor 7 which links up with the units 4 of the associated set I, II, III etc. The system also employs emergency power sources preferably rechargeable batteries conveniently mounted in the power packs 5. As described hereinafter, the units 4 are also interconnected via a bus system with a number of communication or data channels.

Figure 3:
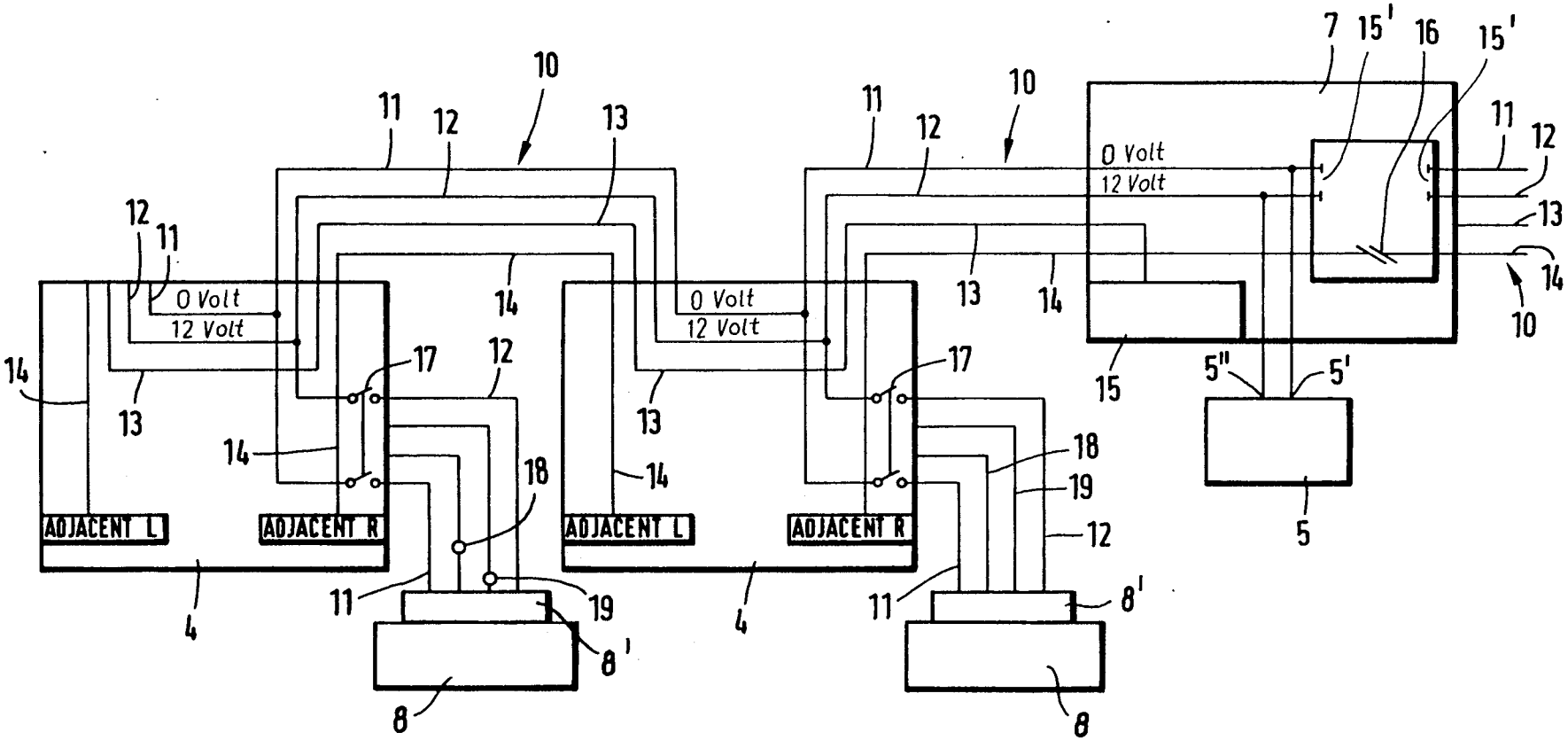
FIG. 3 is a block schematic diagram depicting a power supply and bus of the system pertaining to two adjacent sets of control units.

The valve block 8 of each support 31 has a number of electromagnetic valves which are operated to cause the various hydraulic consumer devices to displace. For example, the valves can cause the props to retract or set, the shifting rams to extend or retract or auxiliary functions such as the extension or retraction of roof bar extensions or side covers to occur. As depicted in FIG. 3, the cables 11, 12, 18, 19 link the unit 4 to the valve blocks 8 via actuators 8' which can employ microprocessors.

Figure 2:
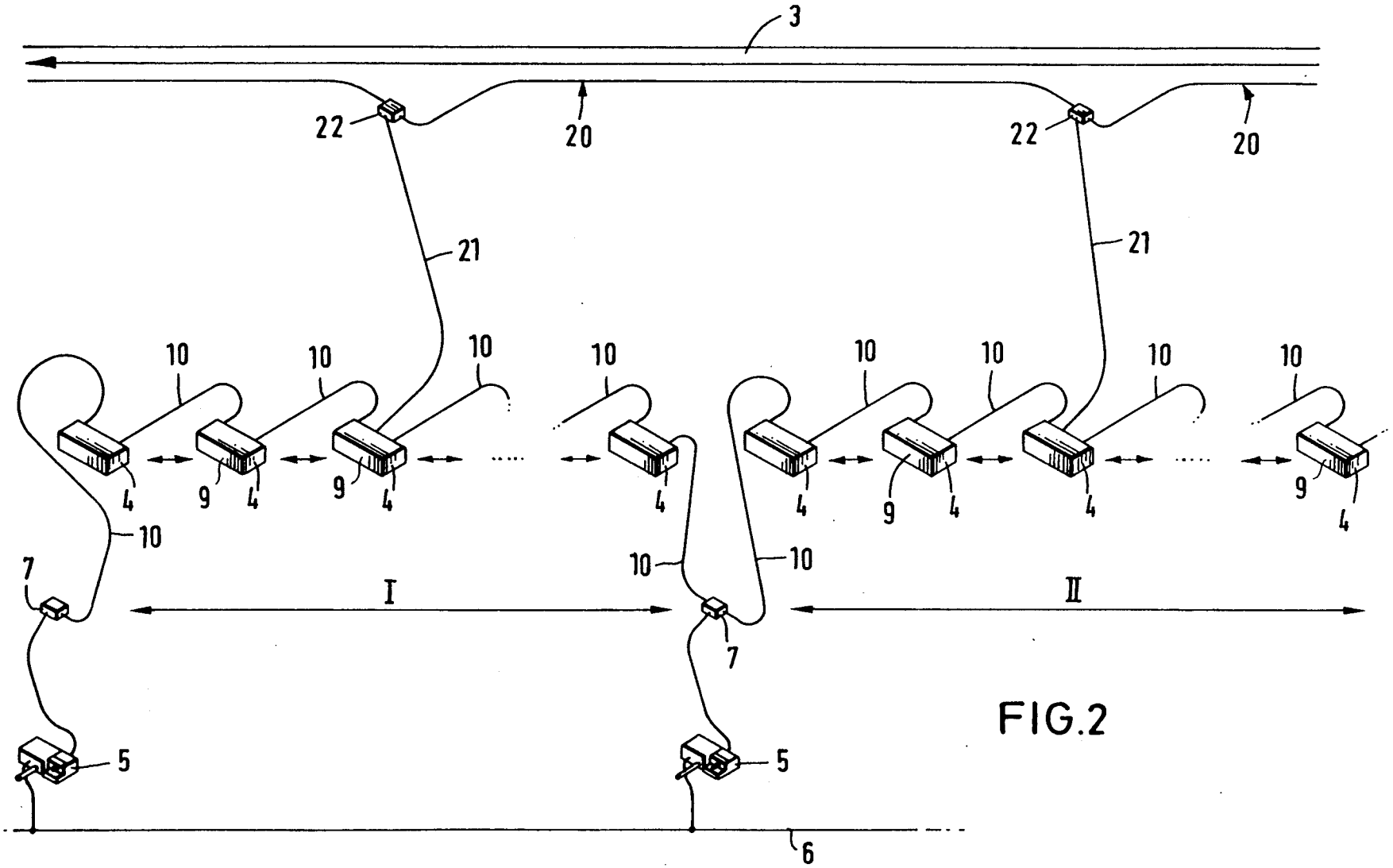
FIG. 2 is a schematic representation of part of the control system pertaining to two adjacent sets of control units.

FIG. 2 shows the way in which the individual units are arranged. The units 4 are illustrated as seen from the keyboards 9 usually at the front of the housings. Within each set I, II, III etc., the units 4 are interconnected via multi-core cables 10 and the units 4 at the ends of the sets I, II, III etc. are connected to adaptors 7 of respective power packs 5. The cables 10 have separate power and control signal and data transmission conductors and, for example, each cable 10 may have four such conductors. The various cables 10 connect with the units 4, the valve actuators 8' and with the adaptors 7 via plug and socket connectors. FIG. 3 shows the interconnection between two adjacent control units 4 and actuators 8' of one of the sets I, II, III etc. of the system, together with an associated adaptor 7 and power pack 5. Two conductors or lines 11, 12 of the cables 10 provide the local power and connect to outputs 5', 5'' of the power pack 5 at and 12 volts d.c. respectively. The conductors 11, 12 terminate within the adaptor 7 as at 15' so that the conductors 11, 12 of one set I, II, III etc are isolated from those of the next adjacent set. The conductors 11, 12 within each unit 4 are connected to the valve actuator 8' by way of a switch 17 which can break the power to the actuator 8' in an emergency. When the switch 17 establishes connection between the conductors 11, 12 and the actuator 8' the unit 4 can supply control signals via conductors 18, 19 to the actuator 8' to cause the selective operation of the valves in the valve block. The actuator 8' enables a low power control signal to be converted into drive current for operating the valves and the conductors 18, 19 can thence be of small diameter. The actuator 8' preferably employs a microprocessor and can generate signals passed back to the control means of the unit 4 to signify the operating state of the valves. The valve block 8 can employ twenty or more electromagnetic valves. The block 8 and actuator 8' would normally be spaced from the associated control unit 4 and linked therewith with the conductors 11, 12, 18, 19 of the multi-core cable 10.

The two other conductors 13, 14 of the cables 10 provide data buses defining parallel communication channels used to transfer data between the units 4. The conductors 14 provide a bi-directional system bus which effectively interconnects all the control units 4 of the system, more particularly, the conductors 14 directly interconnect the units 4 of a set I, II, III etc. and connect with the adaptor 7 at the end of the set I, II, III etc. Within the adaptor 7, the relevant bus conductor 14 of one set I is connected indirectly in a d.c. sense to the relevant bus conductor 14 of the next set II. A coupler means 16, such as an optical coupler, can be used to couple the bus conductors 14. No direct electrical connection occurs at the coupling means 16 yet signals can be transmitted from one set to another along the working. The conductors 13 provide a partial bus which interconnects the units 4 within the set I, II, III etc. for series data transmission and terminates at 15 in the adaptor 7. There is thus no connection between the partial buses 13 of the adjacent sets I, II, III etc.

The provision of the separate parallel data buses 13, 14 itself gives a measure of redundancy which ensures reliability and speed for serial digital data signals. However, in accordance with the invention, a further separate central data bus 20 (FIGS. 1, 2 and 4) is provided in addition. The bus 20 is separate from the buses 13, 14 and extends along the working preferably within a protective channel on the stowage side of the conveyor 3. The bus 20 connects with the control units 4 of the sets I, II, III etc. via lines 21. Each line 21 connects with one of the units 4 of the relevant set I, II, III etc.) preferably, a unit in the centre of the set or an end unit 4 in the vicinity of the power pack 5. The lines 21 connect with the data bus 20 via connectors or adaptors 22. The bus 20 running parallel to the buses 13, 14 thus provides a redundant data path to maintain connection between the units 4 of the sets I, II, III etc. even if the communication via the local cables 10 and coupling means 16 should be interrupted. The data bus 20 is connected to a central control station 27 (FIG. 1), at one end of the working. The data bus 20 is also preferably part of a multi-core cable and for conformity with the cables 10 a four-core cable can be used. Two of the conductors of the cable carry power and current and link via an adaptor 24 to a further power source or power pack 23 disposed at one end of the working. The power pack 23 is connected to the common mains line 6. The other conductor or conductors of the cable provide the data bus for the transmission of the data signals. Although one data signal conductor will suffice, it is preferable to use two conductors so that one can convey special information. Command signals can be transmitted to and from the units 4 in the case of need. The individual lines 21 are likewise multi-core cables but the units 4 are isolated in the d.c. sense from the bus 20 by using coupling means such as optical couplers preferably in the adaptors 22. Power for these couplers and any other signal processing devices in the adaptors 22 can be provided by the conductors connected to the power pack 23.

The control station 27 is also provided with its own power supply in the form of another power pack 28 connected to the mains line 6. The station 27 is linked to the bus 20 via a line 29 and to the system buses 13, 14 via a line 30. This provides a large measure of redundancy whereby various parallel paths are available for transmission of data and control signals.

Figure 4:
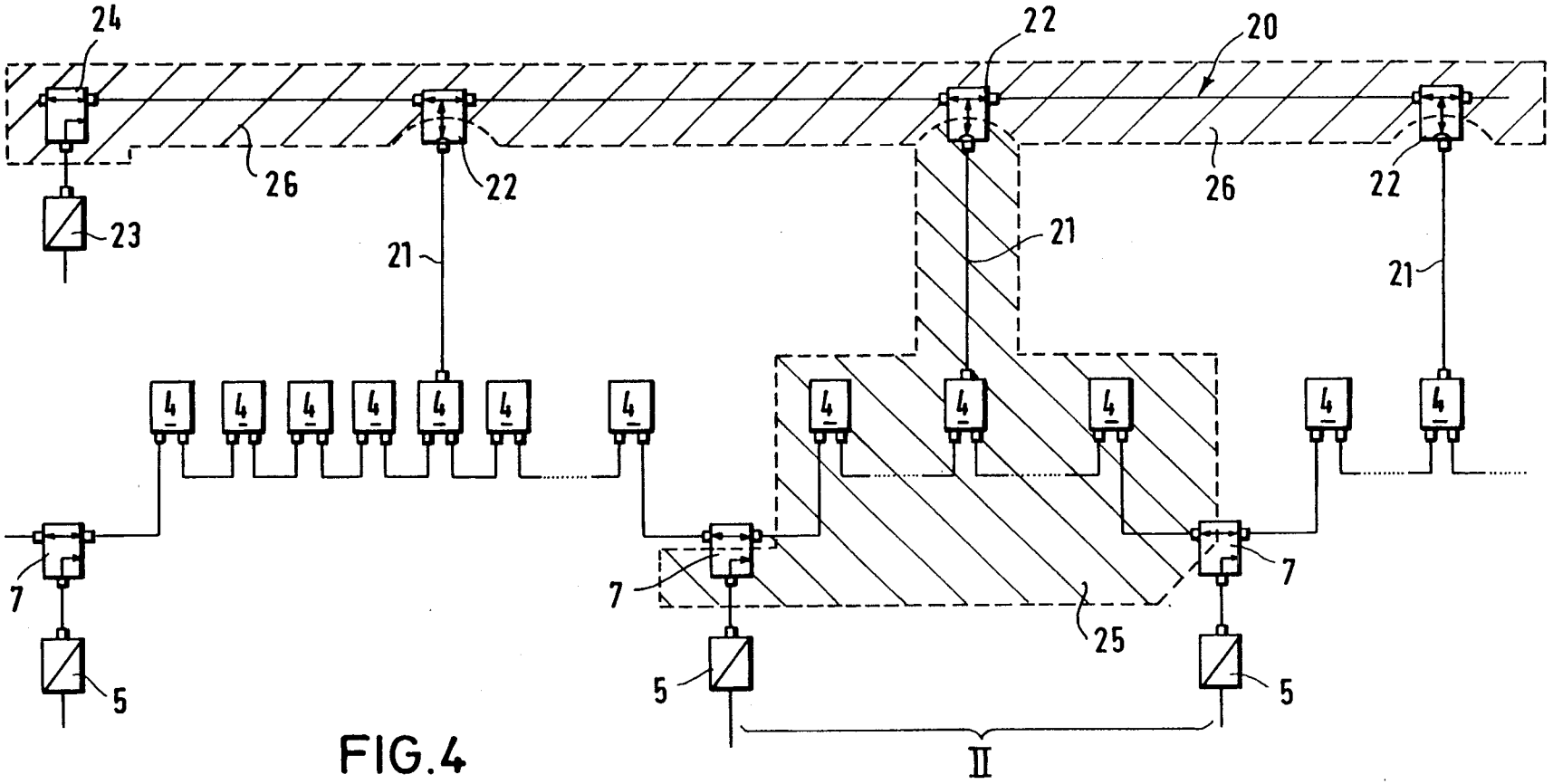
FIG. 4 is a simplified overall schematic representation of the system in conjunction with three sets of control units.

FIG. 4 shows the control units 4 at the centre and ends of a set II. The set II like all the other sets II, III etc. forms an autarchic sub-system 25 independent of the current supply like an intrinsically safe energy island. The central bus 20 with its energy source 23 also forms another sub-system 26 or energy island.

If a cable 10 should break within a set I, II, III etc. a communication path is maintained via the central data bus 20 and at least some of the units 4 will function. If the mains power supply should fail the batteries will maintain the operation of the system. In some circumstances, data may also be transmitted between the units 4 via the buses 13, 14, at least partially, and an interrogation routine for the central station 27 via the data bus 20 and the line 21 can detect faults in adjacent units 4 or sets I, II, III etc.

Although the central bus 20 is particularly useful when faults occur, it can also be used to transmit common data to the units 4 rapidly when the system is operating normally. For example, operating parameters stored in the control means of the units 4 can be altered.

Instead of using optical couplers in the adaptors 7, 22 capacitors or transformers can be employed.

We claim:

1. An electro-hydraulic control system for a mineral mining installation in a mine working which includes a plurality of roof supports equipped with hydraulic devices and electromagnetic valves for operating said devices under control of the system, the installation and the system being subdivided into a plurality of operational groups; said control system comprising individual control units operably associated with the individual supports, each control unit having electronic programmable means for providing control signals usable to activate the valves within the associated one of the groups, individual power sources for providing electrical power via electrical power current circuits to at least the control units of the individual groups, with the electrical power current circuits within the groups being isolated from one another, a system data bus provided within the groups for transmitting data signals between the units and along the groups of units and a further separate independent common data bus which is coupled to some of the units within the groups to create a number or redundant data channels usable if the continuity of the system data bus is interrupted.

2. A system according to claim 1, wherein the further bus is physically separated from the supports and the units.

3. A system according to claim 1, wherein only one unit in each group is connected to the further bus.

4. A system according to claim 1, wherein the power sources are connected to a common a.c. power line and emergency energy storage means is provided to supply power to the units in the event of faults or power failure.

5. A system according to claim 1, wherein means is provided to couple the further bus to the units to permit the transmission of data signals while maintaining electrical isolation between the units and the bus.

6. A system according to claim 1, wherein the further bus is embodied in a multi-core cable which has additional power conductors and a separate power source is connected to these power conductors.

7. A system according to claim 1, wherein the system data bus is composed of bi-directional buses extending through the units of each group and coupling means serves to couple the bi-directional buses indirectly between the units of adjacent groups to enable data signals to be transmitted between the bi-directional buses while isolating the buses in a d.c. sense.

8. A system according to claim 7 wherein the system data bus also comprises separate buses with parts interconnecting the units of each group only.

9. A system according to claim 1, wherein the system data bus employs a number of data channels and coupling means between the group establishes continuity for data transmission while maintaining the electrical power isolation of the groups.

10. A system according to claim 1, wherein the system data bus is embodied as conductors of multi-core cables which also have further conductors connected to said power sources.

11. A system according to claim 10, wherein the power sources are connected to adaptors which in turn connect to the power conductors of the individual groups, and the adaptors have optical couplers for establishing a data link between the groups.

12. A system according to claim 1 and further comprising a central control station connected to the system bus and the further bus.

13. A system according to claim 1, wherein the power sources are all connected to a common a.c. power line.

14. A system according to claim 1 wherein the valves are disposed in blocks equipped with actuators and the blocks and actuators are connected with multi-core cables to the associated control units.

* * * * *